US005465467A

United States Patent [19]

Fan

[11] Patent Number: 5,465,467

[45] **Date of Patent: * Nov. 14, 1995**

[54] METHOD OF MAKING CHEMICAL FIBER KNITTED TOWELLING

[76] Inventor: Sheng-Chi Fan, No. 3-2, Alley 34, Lane 226, Huan Hsi Rd., Sec. 2, Chung Li, Taiwan

[ * ] Notice: The portion of the term of this patent subsequent to Dec. 6, 2011, has been disclaimed.

[21] Appl. No.: 340,893

[22] Filed: Nov. 15, 1994

Related U.S. Application Data

[63] Continuation-in-part of Ser. No. 87,863, Jul. 9, 1993, Pat. No. 5,369,859.

[51] Int. Cl.[6] ..... D06C 7/00

[52] U.S. Cl. ..... 28/167; 28/159; 28/162; 66/9 R

[58] Field of Search ..... 28/159, 167, 162; 66/9 R

[56] References Cited

U.S. PATENT DOCUMENTS 5,369,859 12/1994 Fan ..... 28/167

*Primary Examiner*—John J. Calvert

*Attorney, Agent, or Firm*—Bacon & Thomas

[57] ABSTRACT

A chemical fiber knitted towelling making method which is to brush the pile yarn of the fabric and remove impurities from the pile yarn after the steps of knitting, dyeing and napping, and then to cut the pile yarn to a uniform length after brushing, and then to steam damp the fabric and to dry the damped fabric by steam heat, and then to set the well-treated fabric in shape, and therefore the pile yarn of the fabric does not twist into rings and will not deform as a result of washing with water.

9 Claims, 2 Drawing Sheets

METHOD OF MAKING CHEMICAL FIBER KNITTED TOWELLING

This application is a continuation-in-part of U.S. Ser. No. 08/087,863 filed on Jul. 9, 1993, now U.S. Pat. No. 5,369,859.

BACKGROUND OF THE INVENTION

The present invention relates to an improved method of making chemical or synthetic fiber knitted towelling which eliminates the problems of fiber shedding, pile yarn deformation and pilling.

The current method of making chemical fiber knitted towelling is very simple, as shown in FIG. 1, and includes the steps of knitting (1), dyeing (2), napping (3), and setting in a heat-setting oven at a temperature of between about 160° C.–180° C. (4). After the process of napping, the pile yarn of the knitted fabric is not uniform in length, and broken yarns are still attached to the knitted fabric. Therefore, fiber shedding tends to occur. As a result of washing the towelling, the pile yarn may deform, or form pills.

There is a method of making natural fiber knitted towelling which includes the steps of brushing and shearing so that the pile yarn is maintained uniform in length and evenly spread out. However, this method is not suitable for making chemical or synthetic fiber knitted towelling.

U.S. patent application Ser. No. 08/087,863, which is an application of the present inventor, discloses an improved method of making chemical fiber knitted towelling which eliminates the aforesaid problems by steam damping the fabric and then drying through a steam dryer.

SUMMARY OF THE INVENTION

The present invention is an improvement made on U.S. patent application Ser. No. 08/087,863, i.e. the present invention eliminates the primary shearing process as disclosed in U.S. patent application Ser. No. 08/087,863, and executes the process of brushing before cutting the pile yarn. This method makes the production procedure more flexible while achieving the same result of eliminating the problems of fiber shedding, pile yarn deformation and pilling as the method disclosed in U.S. patent application Ser. No. 08/087,863 does. For example, if pile yarns are not equal in length after the process of shearing, they can be sent back to the shearing machine for a secondary cutting. Secondly, if certain yarns are not raised, the brushing and shearing processes can be repeated. Finally, if the pile yarns are too short or not uniform in length after cutting, the napping process can be repeated. Because the less the number of times of napping the better the quality of the fabric, the present invention is superior over the aforesaid U.S. patent application Ser. No. 08/087,863. Because the present invention eliminates the primary shearing process as disclosed in U.S. patent application Ser. No. 08/087,863, the chance of a repeat napping due to excessively short of pile length is greatly reduced.

The improved method of the present invention comprises additional steps of brushing, shearing, steaming, and drying properly performed before the process of setting and after the process of napping. After the steps brushing and shearing, the knitted fabric is treated through the process of 100° C. steam damping for 20 minutes to improve the friction resistance and shrinkage resistance of the fabric. After the step of steam damping, fine grains are formed and evenly distributed over the surface of the fabric. After steam damping, the fabric is dried in the same industrial dryer at a temperature of about 150° C. for about twenty minutes and then cooled down in the air. When cooled down, the fabric is treated through the process of setting in a heat-setting oven at a temperature of about 160° C.–180° C. The pile yarn of a towelling made according to the present invention does not twist into rings and will not deform as a result of washing with water.

DETAILED DESCRIPTION OF THE PREFERRED EMBODIMENT

Figure 1:
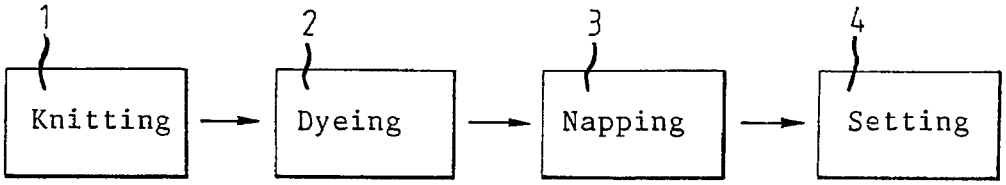
FIG. 1 prior art
FIG. 1 is a production flow chart of a chemical fiber knitted towelling making method according to the prior art.
Figure 2:
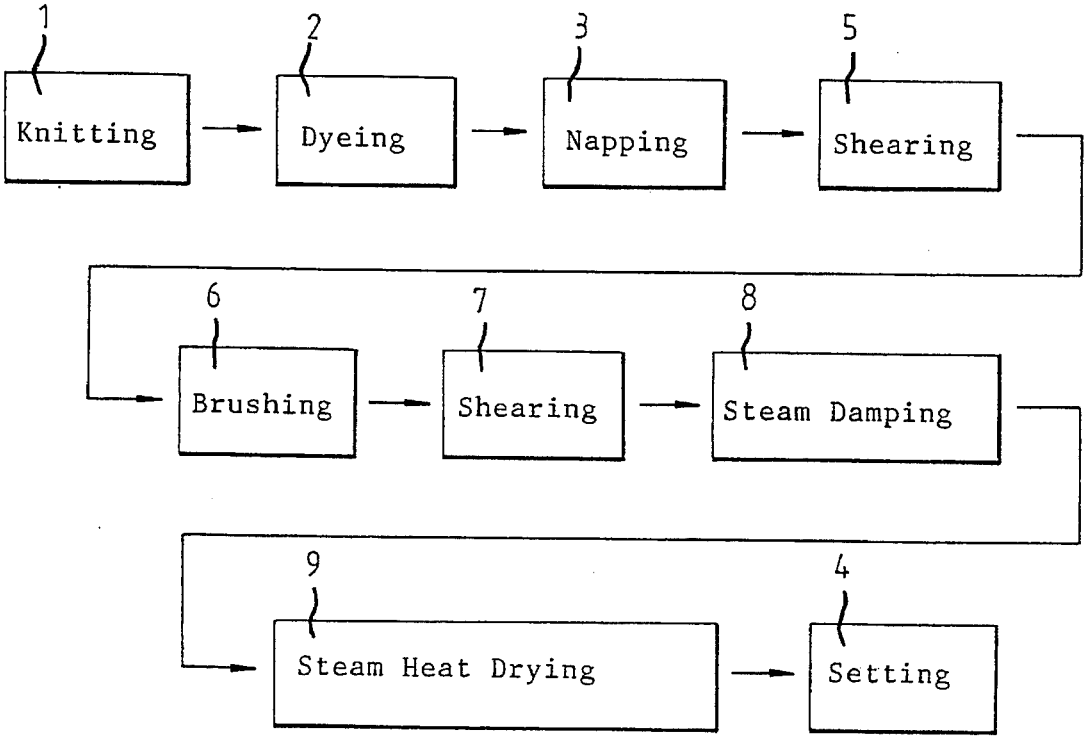
FIG. 2 is a production flow chart of a chemical fiber knitted towelling making method according to U.S. patent application Ser. No. 08/087,863.
Figure 3:
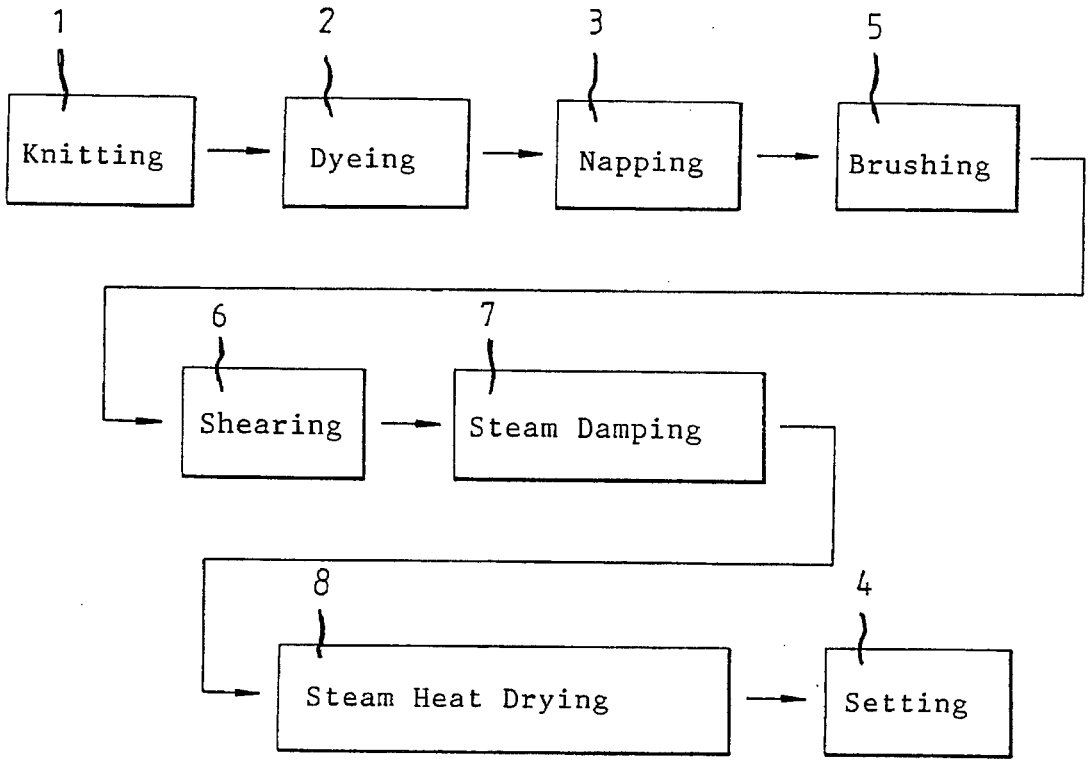
FIG. 3 is a production flow chart of a chemical fiber knitted towelling making method according to the present invention.

Referring to FIG. 3, the improved method of making chemical fiber knitted towelling of the present invention is illustrated which includes conventional steps of knitting 1, dyeing 2, napping 3, and setting 4. Before setting 4 and after napping 3, the improved method comprises additional steps of brushing 5, shearing 6, steam damping 7, and drying 8.

The knitted fabric obtained from the step of knitting 1 is treated by the process of dyeing 2, and then treated by the process of napping 3. After napping 3, the pile yarn of the knitted fabric is treated by the process of brushing 5. The step of brushing 5 is performed by means of the application of two reversed card-wire raising fillets of specification of 27/31, driven by high speed rollers of 1600 RPM. The knitted fabric is fed at a speed of about 3–4 meters per minute. After the process of brushing 5, the pile yarn of the knitted fabric is raised straight, and as a result of the loose fibers being removed, the brilliance of the knitted fabric as well as the binding power of the fibres are improved. After the brushing step 5, the knitted fabric is treated by the process of shearing 6. The step of shearing 6 is to cut the pile yarns of the knitted fabric to about 2–5 mm long. After the shearing step 6, the knitted fabric is treated through the process of 100° C. steam damping 7 for 20 minutes by putting the fabric in the drum of an industrial dryer, which is alternatively rotated in either direction at 34 RPM, while the fabric is simultaneously steam damped by 100° C. steam for about 20 minutes. This process greatly improves the friction resistance and shrinkage resistance of the fabric. After the step of steam damping 7, fine uniform, knitted fibres evenly distributed over the surface of the fabric are formed and the towelling is soft and beautiful. After steam damping 7, the fabric is dried in the same industrial dryer at a temperature of about 150° C. for twenty minutes through heat drying 8. When cooled down, the fabric is treated through the process of setting 4 in a heat-setting oven at a temperature of about 160° C.–180° C.

If some yarns on the surface of the towelling are not raised before the process of shearing 6, the towelling must be sent back to receive the process of brushing 5 again until all yarns on the surface of the towelling have been raised, and then the process of shearing 6 can be performed.

If the yarns are not equal in length after the process of shearing 6, the towelling must be sent back to receive the process of shearing 6 again until the yarns on the surface of the towelling are uniformly cut to the desired length. If the yarns on the surface of the towelling are too short after the process of shearing 6, the processes of napping and brushing can be repeated, and then the yarns on the surface of the towelling are cut again to the desired length.

As indicated, the chemical fiber knitted towelling making method of the present invention achieves the object of eliminating the pile yarn of the fabric from twisting into rings or deforming as a result of washing with water by means of proper brushing and shearing processing procedures and gradual temperature control.

What is claimed is:

1. A method of making chemical fibre knitted towelling requiring the steps of knitting a fabric to produce a knitted fabric, dyeing the knitted fabric, napping the knitted fabric to raise a downy surface on the knitted fabric and heat setting to set the shape and finish the appearance of the knitted fabric the improvement comprising the following steps:

(a) brushing said knitted fabric;

(b) shearing the pile yarn of said knitted fabric to a uniform length;

(c) steaming said knitted fabric in a steam dryer to dampen; and (d) drying said knitted fabric in a steam dryer;

said steps occurring after the step of napping.

2. The method of claim 1 wherein said steps occur before said knitted fabric has been heat set.

3. The method of claim 2 futher comprising a secondary shearing step right after a first shearing step.

4. The method of claim 2 further comprising a second brushing step and a second shearing step before said steaming step.

5.The method of claim 1 wherein said brushing comprises applying two reversed card-wire raising fillets to said fabric, said fillets being driven by high speed rollers which in turn feed said knitted fabric.

6. The method of claim 5 wherein the high speed rollers are driven at 1600 RPM to feed said fabric at 3–4 meters per minute.

7. The method of claim 1 wherein said steaming comprises subjecting said fabric to steam at a temperature of about 100° C. for about 20 minutes.

8. The method of claim 1 wherein the steam drying step comprises drying said fabric in an industrial dryer at a temperature of about 100° C. for about 20 minutes.

9. The method of claim 1 wherein said setting step comprises placing said knitted fabric in an oven at a temperature of between 160°–180° C.

* * * * *